US009497847B2

(12) United States Patent
Sennyu

(10) Patent No.: US 9,497,847 B2
(45) Date of Patent: Nov. 15, 2016

(54) PORT MEMBER OF SUPERCONDUCTING ACCELERATING CAVITY

(75) Inventor: Katsuya Sennyu, Tokyo (JP)

(73) Assignee: MITSUBISHI HEAVY INDUSTRIES MECHATRONICS SYSTEMS, LTD., Hyogo (JP)

( * ) Notice: Subject to any disclaimer, the term of this patent is extended or adjusted under 35 U.S.C. 154(b) by 388 days.

(21) Appl. No.: 13/810,853

(22) PCT Filed: Aug. 31, 2011

(86) PCT No.: PCT/JP2011/069790

§ 371 (c)(1),
(2), (4) Date: Jan. 17, 2013

(87) PCT Pub. No.: WO2012/029861

PCT Pub. Date: Mar. 8, 2012

(65) Prior Publication Data

US 2013/0112455 A1 May 9, 2013

(30) Foreign Application Priority Data

Sep. 3, 2010 (JP) ..... 2010-197821

(51) Int. Cl.
*H05H 7/20* (2006.01)
*H05H 7/22* (2006.01)

(52) U.S. Cl.
CPC ..... *H05H 7/20* (2013.01); *H05H 7/22* (2013.01); *H05H 2007/227* (2013.01)

(58) Field of Classification Search
CPC ..... H05H 7/20; H05H 7/22; H05H 2007/27
USPC ..... 174/50.5
See application file for complete search history.

(56) References Cited

U.S. PATENT DOCUMENTS 3,376,121 A 4/1968 Lawrence
5,239,157 A * 8/1993 Sakano et al. ..... 219/121.64

(Continued)

FOREIGN PATENT DOCUMENTS

CN 2842984 Y 11/2006
EP 0630172 A1 12/1994

(Continued)

OTHER PUBLICATIONS

Elastic constants of niobium—zirconium, hafnium, and tungsten alloys Frey, M. L. and Lonnee, J. E. and Shannette, G. W., Journal of Applied Physics, 49, 4406-4410 (1978), DOI:http://dx.doi.org/10.1063/1.325493.*

(Continued)

*Primary Examiner* — William H Mayo, III
*Assistant Examiner* — Hiram E Gonzalez
(74) *Attorney, Agent, or Firm* — Birch, Stewart, Kolasch & Birch, LLP

(57) ABSTRACT

Provided is a port member of a superconducting accelerating cavity, the entire size of which is reduced and which has enhanced working efficiency to achieve a lower manufacturing cost. In a pickup port (23) of a superconducting accelerating cavity, one end is joined by welding to a port portion (27) formed on a higher order mode coupler (13) which is provided at an end of a cavity body, while the other end is joined by flange coupling to a pickup antenna (22). A port body (33) and a flange portion (35) are integrally formed of a niobium material having low purity or a niobium alloy containing a component other than niobium at a percentage lower than a prescribed percentage. The flange coupling is achieved with use of a quick coupling (41).

3 Claims, 2 Drawing Sheets

(56) References Cited

U.S. PATENT DOCUMENTS

| | | | | |
|---|---|---|---|---|
| 5,532,210 | A * | 7/1996 | Shen | 505/200 |
| 6,348,757 | B1 * | 2/2002 | Marini | 313/359.1 |
| 7,540,502 | B1 * | 6/2009 | Rothgeb et al. | 277/608 |
| 2007/0275860 | A1 | 11/2007 | Sennyu et al. | |

FOREIGN PATENT DOCUMENTS

| | | | |
|---|---|---|---|
| JP | 11-67498 | A | 3/1999 |
| JP | 11-329794 | A | 11/1999 |
| JP | 2000-208300 | A | 7/2000 |
| JP | 2001-313200 | A | 11/2001 |
| JP | 2006-236797 | A | 9/2006 |
| JP | 4358764 | B2 | 11/2009 |

OTHER PUBLICATIONS

Berlincourt, T.G., R.R. Hake, and D.H. Leslie. "Superconductivity At High Magnetic Fields and Current Densities in Some Nb—Zr Alloys." Phys. Rev. Letters vol. 6 (1961): n. pag. Web. doi:10.1103/PhysRevLett.6.671.*

Decision to Grant a Patent issued Dec. 3, 2013 in related Japanese Patent Application No. 2010-197821.

Office Action issued on Dec. 3, 2014 in Chinese Patent Application No. 201180036638.5.

T. Higo, et al., "Estimation of Transient Lorentz Detuning of ICHIRO Cavity with Helium Jacket", ILC-Asia-2007-02, Sep. 17, 2007, pp. 1-10.

T. Saeki, et al., "Initial Studies of 9-Cell High-Gradient Superconducting Cavities At KEK", Proceedings of LINAC 2006, Knoxville, Tennessee, USA, pp. 794-796.

Heisterkamp et al., "Niobium: Future Possibilities—Technology and the Market Place", Proceedings of the International Symposium Niobium, XP-55179095A, Jan. 1, 2001, 32 pages.

Kako et al., "Cryomodule Tests of Four Tesla-like Cavities in the STF Phase-1.0 for ILC", PAC'09 Global Design Effort, XP-55178464A, May 5, 2009, pp. 1-27.

Rusnak et al., "Test Results for a Heat-Treated 4-Cell 805-MHZ Superconducting Cavity", Proceedings of the 1995 Particle Accelerator Conference: Papers from the Sixteenth Biennial Particle Accelerator Conf., an International Forum on Accelerator Science and Tech., vol. 3, XP-10166149A, May 1, 1995, pp. 1636-1638.

Singer et al., "Quality requirements and control of high purity niobium for superconducting RF cavities", Physica C, vol. 386, 2003, pp. 379-384.

Starling et al., "Superconducting Super Collider Laboratory Coupled-Cavity Linac Mechanical Design", Linear Accelerator Conference Proceedings, vol. 1, XP008022383, Aug. 28, 1992, pp. 241-243.

Decision to Grant a Patent issued Jul. 3, 2015 for corresponding Chinese Patent Application No. 201180036638.5 with an English Translation.

* cited by examiner

PORT MEMBER OF SUPERCONDUCTING ACCELERATING CAVITY

TECHNICAL FIELD

The present invention relates to a port member of a superconducting accelerating cavity, which is joined by welding to a port portion formed in a beam pipe part.

BACKGROUND ART

A superconducting accelerating cavity is to accelerate charged particles which travel through the inside of the superconducting accelerating cavity. A beam pipe provided at the end of the superconducting accelerating cavity is equipped with a harmonic (HOM) coupler for removing harmonics which disturb beam acceleration (i.e., for extracting the harmonics, which are induced in the superconducting accelerating cavity, out of the superconducting accelerating cavity) and an input coupler for inputting microwaves into a cavity body. The input coupler is flange-coupled to an input port attached to the beam pipe (see, for example, Patent Literature 1). The higher order mode coupler is flange-coupled to a pickup port having a pickup antenna for extracting harmonics to the outside, the pickup antenna being attached to a lateral part of an outer conductor.

Conventionally, the pickup port is configured as shown in FIG. 4 in one example. The pickup port 71 is composed of a generally cylinder-shaped port body 73 and a flange portion 75 attached to an outer peripheral side of one end of a port body 73 by welding such as electron beam welding. The other end of the port body 73 is welded by, for example, electron beam welding to a port portion 79 which is formed so as to go through a lateral face of an outer conductor 77.

The flange portion 75 is firmly attached by using bolts to a flange of a pickup antenna side through a sealing member. Accordingly, the flange portion 75 has a through hole 81 formed for the bolts. The input port is also made to have the same configuration as the pickup port.

The accelerating cavity body, the beam pipe, the higher order mode coupler, and the port body 73 are formed of a superconducting material such as niobium materials having high purity (e.g., 99.85% or more). The flange portion 75 is formed of, for example, a niobium titanium alloy having a titanium content of 45 to 55%.

The sealing member is made use of, for example, a material such as metal O rings which require high planar pressure and have high sealability. The flange portion 75 needs predetermined hardness in order to compress the sealing member, and so the sealing member is formed of a niobium titanium alloy.

When the inside of the superconducting accelerating cavity is purified by electric polishing after assembly, the niobium titanium alloy may possibly corrode by polishing liquid. Accordingly, the flange portion 75 is attached to an outer peripheral side of the port body 73 so as not to come into contact with the polishing liquid.

CITATION LIST

Patent Literature

PTL 1

Japanese Unexamined Patent Application, Publication No. Hei11-329794

SUMMARY OF INVENTION

Technical Problem

In the case of a conventional pickup port configuration shown in FIG. 4, the pickup port is composed of two components, a port body 73 and a flange portion 75, and so the manufacturing process thereof takes time and effort.

Moreover, a through hole 81 for bolt joining is provided on a part of the outer peripheral side of the flange portion 75 which is outside of a seal portion, which increases an external diameter of the flange portion 75. As a result, the flange portion 75 disturbs electron beam welding of an outer conductor 77 to a beam pipe 78. Accordingly, when the port body has the flange portion 75 joined thereto, the outer conductor 77 cannot be welded to the beam pipe 78. It is necessary, therefore, to first join the port body 73 to the port portion 79, and then join the outer conductor 77 to the beam pipe 78, before welding the flange portion 75 to the port body 73. Consequently, it is impossible to improve working efficiency.

Further, a sufficient penetration depth is needed in order to maintain the joint strength of the flange portion 75. This increases a bead width. Accordingly, post-processing is needed in order to secure quality in the flatness and the like of a sealing portion positioned in the vicinity of a joint portion.

In view of such a situation, an object of the present invention is to provide a port member of a superconducting accelerating cavity, the entire size of which is reduced and which has enhanced working efficiency to achieve a lower manufacturing cost.

Solution to Problem

The present invention employs the following solutions to solve the foregoing problems.

More specifically, one aspect of the present invention is a port member of a superconducting accelerating cavity, one end of the port member being joined by welding to a port portion formed in a beam pipe provided at an end of a cavity body, and the other end being joined by flange coupling to an external structure, the port member including: a port body; and a flange, which are integrally formed of a niobium material having low purity or a niobium alloy containing a component other than niobium at a percentage lower than a prescribed percentage, the flange coupling being achieved with use of a quick coupling.

According to the port member in this aspect, the port body and the flange are integrally formed of a niobium material having low purity or a niobium alloy containing a component other than niobium at a percentage lower than a prescribed percentage. Therefore, it becomes possible to make the member with predetermined hardness and to maintain sufficient sealing performance.

Since the port body and the flange are integrally formed, the number of components can be decreased.

Since the flange coupling to the external structure is achieved with use of a quick coupling, it becomes unnecessary to provide the flange portion with a joining structure, such as a through hole for bolt insertion, on the outer peripheral side of a sealing part. As a result, the diameter of the flange portion can be reduced. Since the diameter of the flange portion is reduced in this way, the entire size of the port member can be reduced. Moreover, since the port body including the flange portion can be joined by welding to a target part, a higher order mode coupler as a single body can be assembled in advance for example.

Since the quick coupling is used, assembly operation can be conducted easily in a short time as compared with the case of joining by bolts, so that efficiency in assembly work can be enhanced.

This makes it possible to lower the manufacturing cost of the superconducting accelerating cavity.

It is to be noted that a term "low purity" is herein used to refer to being lower in purity than pure niobium with an impurity content being 1 to 10 weight % for example. Moreover, a term "prescribed percentage" refers to the percentage of a component other than niobium being about 1 to 10 weight %.

For example, as the niobium alloy, a niobium zirconium alloy having a zirconium content of 1 to 10 weight % may be used.

As the niobium alloy, a niobium hafnium alloy having a hafnium content of 1 to 10 weight % may also be used.

Advantageous Effects of Invention

According to the present invention, provided is a port member of a superconducting accelerating cavity, one end of the port member being joined by welding to a port portion formed in a beam pipe provided at an end of a cavity body, and the other end being joined by flange coupling to an external structure, the port member including: a port body; and a flange, which are integrally formed of a niobium material having low purity or a niobium alloy containing a component other than niobium at a percentage lower than a prescribed percentage, the flange coupling being achieved with use of a quick coupling. Accordingly, it becomes possible to reduce the entire size and to enhance working efficiency to achieve a lower manufacturing cost.

DESCRIPTION OF EMBODIMENTS

Hereinafter, a port member according to one embodiment of the present invention will be explained with reference to FIGS. 1 to 3.

Figure 1:
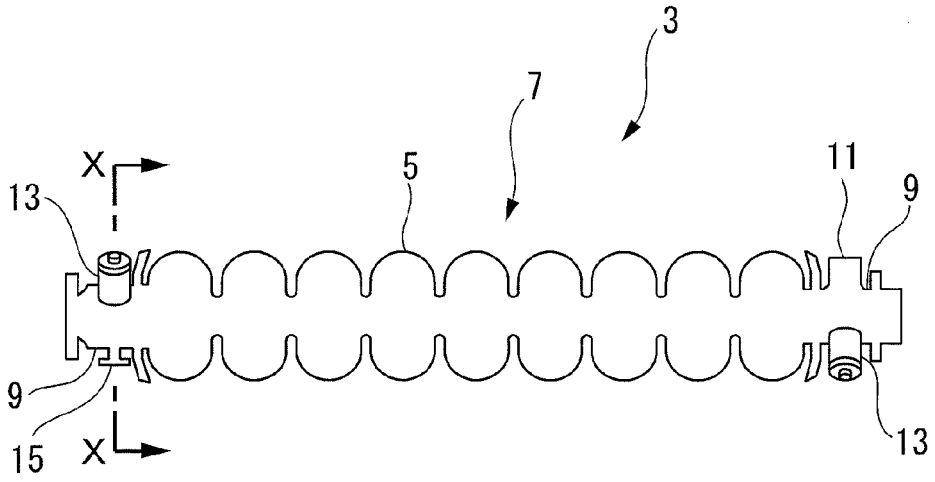
FIG. 1 is a front view showing a superconducting accelerating cavity with use of a port member according to one embodiment of the present invention.

FIG. 1 is a front view showing a superconducting accelerating cavity with use of a port member according to one embodiment of the present invention. FIG. 2 is an X-X cross sectional view of FIG. 1. FIG. 3 is a cross sectional view showing an external structure attached to the port member of FIG. 2.

As shown in FIG. 1, a superconducting accelerating cavity 3 includes a cavity body 7 composed of, for example, nine cells 5 joined and combined by welding, the cells 5 having a cylindrical shape with a bulged center portion. The superconducting accelerating cavity 3 also includes a beam pipe 9 attached to both the ends of the cavity body 7.

One beam pipe 9 is equipped with an input port 11 for attaching an input coupler for inputting microwaves into the cavity body 7 and a higher order mode coupler 13 for discharging harmonics, which disturb acceleration of a beam excited in the cavity body 7, out of the cavity body 7. The other beam pipe 9 is equipped with a higher order mode coupler 13 and a monitor port (port member) 15 for attaching a monitor portion which monitors the state of acceleration of a beam excited in the cavity body 7. The monitor port 15 is joined by, for example, electron beam welding to a port portion 17 formed so as to go through the beam pipe 9.

The cell 5, the beam pipe 9, the input port 11, and the higher order mode coupler 13 are formed of a superconducting material such as niobium materials with high purity. The beam pipe 9, the input port 11, and the higher order mode coupler 13 constitute a beam pipe part of the present invention.

Figure 2:
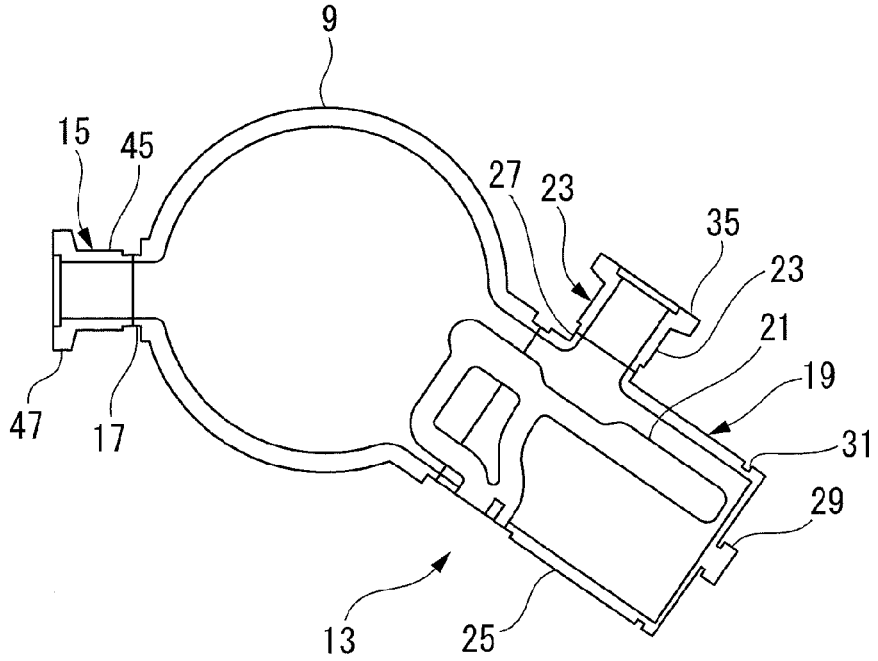
FIG. 2 is an X-X cross sectional view of FIG. 1.
Figure 3:
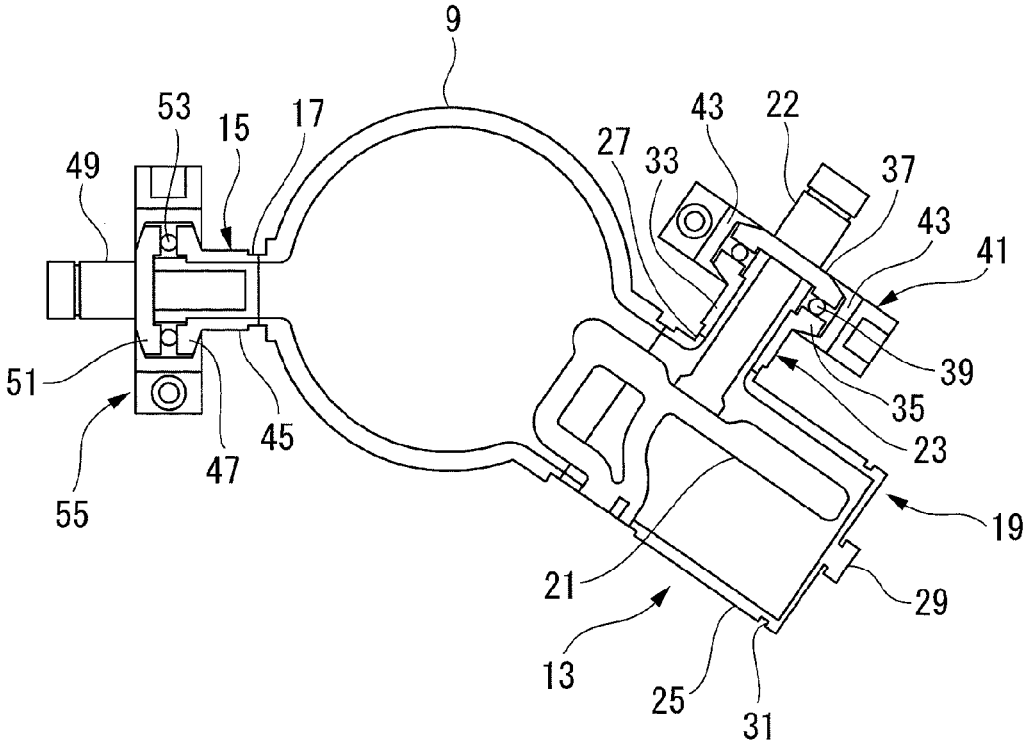
FIG. 3 is a cross sectional view showing an external structure attached to a port portion of FIG. 2.
Figure 4:
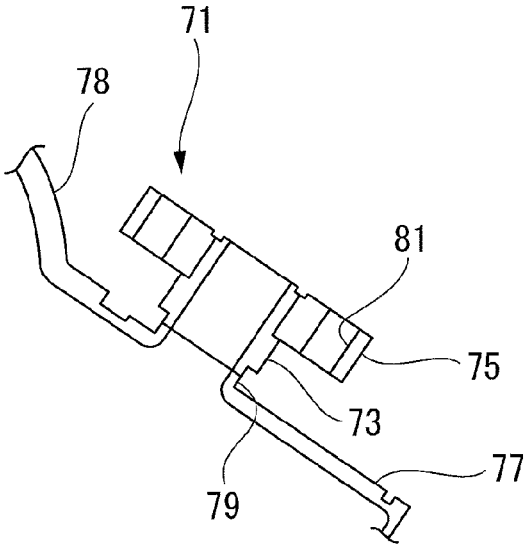
FIG. 4 is a fragmentary sectional view showing a conventional port portion.

The higher order mode coupler 13 includes an outer conductor 19, an inner conductor 21, and a pickup port (port member) 23 for inserting a pickup antenna (external structure) 22 to the inside as shown in FIG. 2.

The outer conductor 19 has a cylindrical shape with one end face thereof being opened to form an opened portion. The outer conductor 19 includes a body portion 25 configured so that the opened portion is joined to the beam pipe 7, a port portion 27 formed so as to go through a lateral part of the body portion 25, and a protruding portion 29 formed so as to protrude from an end face of the body portion 25. The inner conductor 21 is joined and attached to a lateral part of the body portion 25.

The end face of the body portion 25 is formed to have a thickness smaller than the lateral face. A trench 31 is formed around the entire periphery of the lateral face of the body portion 25 at a part in the vicinity of the end face. Accordingly, the end face of the body portion 25 is deformed relatively easily.

The end face of the protruding portion 29 is deformed when the protruding portion 29 is pushed and pulled while being gripped by an unshown gripping member from the outside. By this operation, a distance to the inner conductor 21 placed in the inside of the body portion 25 can be adjusted.

The port portion 27 is formed so as to protrude outward from the body portion 25. The port portion 27 is formed into a pipe shape having a generally circular cross section.

The pickup port 23 is integrally formed at one end of a generally cylinder-shaped port body 33 so that a flange portion 35 protrudes outward. The pickup port 23 is joined by, for example, electron beam welding to a joint surface of the port portion 27 so that the flange portion 35 is positioned on the outer peripheral side of the outer conductor 19.

The pickup port 23 is formed of, for example, a niobium zirconium alloy having a zirconium content of about 3 weight %. The formation material of the pickup port 23 is not limited to the niobium zirconium alloy but may be any material having predetermined hardness (hardness sufficient enough to be able to secure the planar pressure of a later-described sealing member). For example, the pickup port 23 may be formed of a niobium zirconium alloy having a zirconium content of 1 to 10 weight %. The pickup port 23 may also be formed of a niobium hafnium alloy having a hafnium content of 1 to 10 weight %. The pickup port 23 may further be formed of a niobium material with low purity, such as niobium materials containing 1 to 10 weight % impurity.

The pickup antenna 22 is inserted into an interior space formed by the pickup port 23 and the port portion 27 for extracting harmonics to the outside.

A flange portion 37 is attached to a middle part in a longitudinal direction of the pickup antenna 22 so as to face the flange portion 35 of the pickup port 23.

The flange portion 35 and the flange portion 37 are tightened by a quick coupling 41 in the state where a metal O ring 39, which is a sealing member requiring a high planar pressure and having high sealability, is interposed therebetween.

The flange portion 35 and the flange portion 37 have surfaces which face each other and which are generally parallel to each other. The other surfaces opposite to these surfaces have inclined surfaces which come closer to each other toward the outer peripheral side.

The quick coupling 41 is composed of a plurality of fitting portions 43 which are rotatably connected with each other to form a generally peripheral shape and which are linked so that a peripheral length of the quick coupling 41 may change.

The fitting portion 43 is configured to be fitted onto the inclined surfaces so as to pinch the flange portion 35 and the flange portion 37 and to apply a predetermined planar pressure to the metal O ring 39 once a predetermined peripheral length is obtained. The quick coupling 41 is configured to have a peripheral length reduced by an unshown clamp member and is to be fixed by the clamp member so as to maintain a predetermined peripheral length once the predetermined peripheral length is obtained.

The monitor port 15 is integrally formed at one end of a generally cylinder-shaped port body 45 so that a flange portion 47 protrudes outward. The monitor port 15 is joined by, for example, electron beam welding to a joint surface of the port portion 17 so that the flange portion 47 is positioned on the outer peripheral side of the beam pipe 9.

The monitor port 15 is formed of the same formation material as the pickup port 23.

A flange portion 51 is attached to a middle part in a longitudinal direction of a monitor antenna (external structure) 49 so as to face the flange portion 47 of the monitor port 15.

The flange portion 47 and the flange portion 51 are tightened by a quick coupling 55 having the same configuration as the pickup antenna 22 in the state where a metal O ring 53, which is a sealing member requiring a high planar pressure and having high sealability, is interposed therebetween.

A description will be given of the operations and effects of the pickup port 23 and the monitor port 15 configured as described in the foregoing.

A description is first given of manufacturing the higher order mode coupler 13. The outer conductor 19, the inner conductor 21, and the pickup port 23 are manufactured into respective specified shapes. The pickup port 23 is formed of a niobium zirconium alloy having a zirconium content of about 3 weight %. As a result, it becomes possible to make the member with predetermined hardness, so that a planar pressure which sufficiently compresses the later-described metal O ring 39 can be secured, and sufficient sealing performance can be maintained.

The pickup port 23 is welded to the port portion 27, and then the inner conductor 21 is attached to the outer conductor 19. For example, electron beam welding is employed as the welding for joining operation, by which the higher order mode coupler 13 is manufactured.

In this case, the flange portion 35 is joined to the flange portion 37 of the pickup antenna 22 by the quick coupling 41. As a consequence, it becomes unnecessary to provide the flange portion 35 with a joining structure, such as a through hole for bolt insertion, on the outer peripheral side of a sealing part. As a result, the diameter of the flange portion 35 can be reduced.

Since the diameter of the flange portion 35 is reduced in this way, the entire size of the pickup port 23 can be reduced.

Next, assembly of the beam pipe 9 is conducted.

With the diameter of the flange portion 35 reduced, the flange portion 35 does not disturb emission of an electron beam when the outer conductor 19 of the higher order mode coupler 13 and the beam pipe 9 are joined. Accordingly, it becomes possible to join the pickup port 23 to the port portion 27.

Further, the monitor port 15 is welded by, for example, electron beam welding to the port portion 17 of the beam pipe 9.

Next, the pickup antenna 22 is attached to the pickup port 23. The pickup antenna 22 is inserted into a hollow portion of the pickup port 23, and the flange portion 35 and the flange portion 37 are made to face each other with the metal O ring 39 interposed therebetween.

In this state, the quick coupling 41 is fitted so that a plurality of the fitting portions 43 pinch the flange portion 35 and the flange portion 37. A clamp member is operated to reduce a peripheral length of the quick coupling 41 so that the flange portion 35 and the flange portion 37 are tightened against each other to compress the metal O ring 39. Once the quick coupling 41 obtains a predetermined peripheral length, the quick coupling 41 is fixed by the clamp member so that the predetermined peripheral length is maintained.

The monitor antenna 49 is also attached to the monitor port 15 with use of a quick coupling 55 by generally the same method as the pickup antenna 22.

Thus, since the quick couplings 41 and 55 are used for attaching the pickup antenna 22 and the monitor antenna 49, assembly operation can be conducted easily in a short time as compared with the case of joining by bolts, so that efficiency in assembly work can be enhanced.

This makes it possible to lower the manufacturing cost of the superconducting accelerating cavity 3.

It should be understood that the present invention is not limited to the embodiment disclosed and various modifications may be made without departing from the scope of the present invention.

REFERENCE SIGNS LIST

3 Superconducting accelerating cavity
7 Cavity body
9 Beam pipe
13 Higher order mode coupler
15 Monitor port
17 Port portion
27 Port portion
33 Port body
35 Flange portion
41 Quick coupling
45 Port body
47 Flange portion
55 Quick coupling

The invention claimed is:

1. A port member of a superconducting accelerating cavity comprising:

a port body welded to a port portion formed in a beam pipe part provided at an end of a cavity body, the beam pipe being formed of a niobium material having high purity; and a first flange portion configured to be attached to an external structure, wherein both the port body and the first flange portion are integrally formed of a niobium material having lower purity than that of the beam pipe part or a niobium alloy containing a component other than niobium at a percentage lower than a prescribed percentage, wherein the first flange portion is attached to a second flange portion included in the external structure by a quick coupling, wherein the first flange portion and the second flange portion are tightened by the quick coupling in the state where a sealing member is interposed therebetween, wherein the quick coupling includes a plurality of fitting portions which are connected with each other so that a peripheral length of the quick coupling can be changed and a clamp member which reduces the peripheral length of the quick coupling, and wherein the fitting portion is configured to apply a predetermined planar pressure to the sealing member when a predetermined peripheral length is obtained.

2. The port member of the superconducting accelerating cavity according to claim 1, wherein as the niobium alloy, a niobium zirconium alloy having a zirconium content of 1 to 10weight % is used.

3. The port member of the superconducting accelerating cavity according to claim 1, wherein as the niobium alloy, a niobium hafnium alloy having a hafnium content of 1 to 10weight % is used.

* * * * *